US010405594B2

(12) United States Patent
Underwood et al.

(10) Patent No.: US 10,405,594 B2
(45) Date of Patent: Sep. 10, 2019

(54) INNER LINING FABRIC

(71) Applicant: International Textile Group, Inc., Greensboro, NC (US)

(72) Inventors: Joey K. Underwood, Greenville, SC (US); Jacques A. Cantin, Greenville, SC (US)

(73) Assignee: International Textile Group, Inc., Greensboro, NC (US)

( * ) Notice: Subject to any disclaimer, the term of this patent is extended or adjusted under 35 U.S.C. 154(b) by 120 days.

(21) Appl. No.: 15/155,117

(22) Filed: May 16, 2016

(65) Prior Publication Data

US 2016/0338433 A1 Nov. 24, 2016

Related U.S. Application Data

(60) Provisional application No. 62/164,856, filed on May 21, 2015, provisional application No. 62/257,990, filed on Nov. 20, 2015.

(51) Int. Cl.

| | |
|---|---|
| ***A62B 17/00*** | (2006.01) |
| ***A41D 27/02*** | (2006.01) |
| ***A41D 31/08*** | (2019.01) |
| *A41D 1/06* | (2006.01) |
| *A41D 1/02* | (2006.01) |

(52) U.S. Cl.

CPC ..... *A41D 27/02* (2013.01); *A41D 31/08* (2019.02); *A41D 1/02* (2013.01); *A41D 1/06* (2013.01); *A41D 2500/20* (2013.01); *A41D 2600/20* (2013.01)

(58) Field of Classification Search

CPC ..... A41D 27/02; A41D 2500/20; A41D 31/0022; D03D 15/12

USPC ..... 2/272, 458; 442/181, 203; 139/383 A

See application file for complete search history.

(56) References Cited

U.S. PATENT DOCUMENTS

| | | | |
|---|---|---|---|
| 2,333,824 | A | 11/1943 | Shoept |
| 2,696,723 | A | 12/1954 | Fritht, Jr. |
| 3,019,821 | A | 2/1962 | White |
| 3,097,442 | A | 7/1963 | Willingham, Jr. |
| 3,710,395 | A | 1/1973 | Spano et al. |
| 3,806,959 | A | 4/1974 | Gross |

(Continued)

FOREIGN PATENT DOCUMENTS

| | | |
|---|---|---|
| AU | 2005200963 | 3/2005 |
| DE | 202010011193 | 9/2010 |

(Continued)

*Primary Examiner* — Sally Haden

*Assistant Examiner* — Jillian K Pierorazio

(74) *Attorney, Agent, or Firm* — Dority & Manning, PA

(57) ABSTRACT

Protective garments are disclosed having an inner lining with high lubricity and high strength characteristics. The inner lining, in one embodiment, contains spun yarns combined with multifilament yarns. In accordance with the present disclosure, the multifilament yarns are present in the warp direction and in the fill direction. In addition, the multifilament yarns may outnumber the spun yarns in both the warp direction and the fill direction. In this manner, a fabric is produced not only having good lubricity characteristics but also having a balance of properties. For instance, in one embodiment, the shrink properties of the fabric in the warp direction substantially match the shrink properties of the fabric in the fill direction.

20 Claims, 4 Drawing Sheets

(56) References Cited

U.S. PATENT DOCUMENTS 3,889,305 A * 6/1975 Goldberg ..... A47C 31/001 5/698
4,034,417 A 7/1977 Ellis
4,039,709 A 8/1977 Newman
4,451,934 A 6/1984 Giollo
4,502,153 A 3/1985 Lapedes et al.
4,604,759 A 8/1986 Bowman et al.
4,615,934 A 10/1986 Ellison
4,668,234 A 5/1987 Vance et al.
4,709,421 A 12/1987 Grilliot et al.
4,748,691 A 6/1988 Grilliot et al.
4,830,897 A 5/1989 Lichtenstein
4,843,646 A 7/1989 Grilliot et al.
4,865,906 A 9/1989 Smith, Jr.
4,897,886 A 2/1990 Grilliot et al.
4,920,000 A 4/1990 Green
5,001,781 A 3/1991 Grilliot et al.
5,001,783 A 3/1991 Grilliot et al.
5,031,242 A 7/1991 Aldridge et al.
5,127,106 A 7/1992 Aldridge
5,131,097 A 7/1992 Grilliot et al.
5,136,723 A 8/1992 Aldridge et al.
5,141,542 A 8/1992 Fangeat et al.
5,150,476 A 9/1992 Statham et al.
5,236,769 A 8/1993 Paire
5,299,602 A 4/1994 Barbeau et al.
5,323,815 A 6/1994 Barbeau et al.
5,362,555 A 11/1994 Lal
5,499,663 A 3/1996 Barbeau et al.
5,527,597 A 6/1996 Stanhope et al.
5,539,928 A 7/1996 Aldridge
5,604,718 A 6/1997 Aldridge
5,685,015 A 11/1997 Aldridge
5,691,040 A 11/1997 Barbeau et al.
5,694,981 A 12/1997 Stanhope et al.
5,724,673 A 3/1998 Aldridge
5,727,401 A 3/1998 Statham
5,819,316 A 10/1998 Aldridge
5,824,614 A 10/1998 Gadoury et al.
5,830,319 A 11/1998 Landin
5,830,574 A 11/1998 Gadoury
5,849,648 A 12/1998 Kent et al.
5,858,888 A 1/1999 Underwood et al.
5,860,163 A 1/1999 Aldridge
5,891,813 A 4/1999 Gadoury
5,885,307 A 5/1999 Gadoury
5,920,905 A 7/1999 Aldridge
5,928,971 A 7/1999 Ellis
6,065,153 A 5/2000 Underwood et al.
6,132,476 A 10/2000 Lunsford et al.
6,192,520 B1 2/2001 Underwood et al.
6,247,179 B1 6/2001 Underwood et al.
6,341,384 B1 1/2002 Hayes
6,397,401 B2 6/2002 Belcher
6,430,754 B1 8/2002 Taylor et al.
6,547,835 B1 4/2003 Lunsford et al.
6,602,600 B2 8/2003 Zhu
6,626,964 B1 9/2003 Lunsford et al.
6,668,868 B2 12/2003 Howland et al.
6,693,052 B2 2/2004 Howland
6,699,802 B1 3/2004 Hainsworth et al.
6,735,789 B2 5/2004 Kelleher et al.
6,818,024 B2 11/2004 Lunsford et al.
6,840,288 B2 1/2005 Zhu et al.
6,861,378 B2 3/2005 Cunningham
6,867,154 B1 3/2005 Lunsford et al.
6,955,193 B2 10/2005 Hainsworth et al.
6,974,785 B1 12/2005 Barbeau
6,983,490 B1 1/2006 Lewis et al.
7,013,496 B2 3/2006 Dunn
7,065,950 B2 6/2006 Zhu et al.
7,073,538 B2 7/2006 Bhatnagar
7,156,883 B2 1/2007 Lovasic et al.
7,284,398 B2 10/2007 Hubner
7,402,538 B2 7/2008 Bader et al.
7,589,036 B2 9/2009 Corner
7,634,819 B2 12/2009 Grey
7,676,855 B2 3/2010 Dunn
7,854,017 B2 12/2010 Laton
7,862,865 B2 1/2011 Truesdale, III et al.
RE42,209 E 3/2011 Lunsford
7,988,779 B2 8/2011 Disalvo et al.
7,993,415 B2 8/2011 Vogt et al.
8,017,532 B2 9/2011 Okada
8,063,116 B2 11/2011 Trogolo et al.
8,347,420 B2 1/2013 Kruzsewski et al.
2001/0009832 A1 7/2001 Shaffer et al.
2002/0016985 A1 2/2002 Kelleher et al.
2002/0069453 A1 6/2002 Kelleher et al.
2003/0082972 A1 5/2003 Monfalcone, III et al.
2003/0167580 A1 9/2003 Lunsford et al.
2003/0190853 A1 10/2003 Lovingood
2003/0203690 A1 10/2003 Hess
2003/0226612 A1 12/2003 Zhu et al.
2003/0228812 A1* 12/2003 Stanhope ..... A41D 31/0022 442/49
2003/0232560 A1 12/2003 Corner
2004/0029473 A1 2/2004 McKee et al.
2004/0045103 A1 3/2004 Lunsford
2004/0065072 A1 4/2004 Zhu et al.
2004/0092187 A1 5/2004 Favier et al.
2004/0121869 A1* 6/2004 Becella ..... B29C 70/22 474/267
2004/0152378 A1 8/2004 Stanhope et al.
2004/0248494 A1 12/2004 Hartgrove et al.
2005/0025962 A1 2/2005 Zhu et al.
2005/0032449 A1 2/2005 Lovasic et al.
2005/0037057 A1 2/2005 Schuette et al.
2005/0050619 A1 3/2005 Dunn
2005/0060820 A1 3/2005 Lunsford et al.
2005/0064020 A1 3/2005 Schuette
2005/0097652 A1 5/2005 Rock et al.
2005/0221706 A1 10/2005 Bader et al.
2005/0245163 A1 11/2005 Aneja et al.
2005/0287364 A1 12/2005 Zhu et al.
2006/0040575 A1 2/2006 Kelleher et al.
2006/0084337 A1 4/2006 Corner et al.
2006/0143809 A1 7/2006 Dunn
2006/0160454 A1 7/2006 Handermann et al.
2006/0264136 A1 11/2006 Chiantese
2007/0026752 A1 2/2007 Thiriot
2007/0123127 A1 5/2007 Hirschmann et al.
2007/0137012 A1 6/2007 Laton
2007/0184737 A1* 8/2007 Corner ..... A41D 31/0022 442/203
2007/0224902 A1 9/2007 Hilleary et al.
2007/0249250 A1 10/2007 Servajean
2008/0057807 A1 3/2008 Tutterow et al.
2008/0086798 A1 4/2008 Allen et al.
2008/0148468 A1 6/2008 Laton et al.
2008/0152888 A1 6/2008 Tutterow et al.
2008/0227352 A1 9/2008 Byles et al.
2008/0295232 A1 12/2008 Truesdale, III et al.
2009/0030111 A1 1/2009 Barnes et al.
2009/0139016 A1 6/2009 Zhu et al.
2009/0178186 A1 7/2009 Truesdale
2009/0226653 A1 9/2009 Harris et al.
2009/0255038 A1 10/2009 Curtis
2010/0024103 A1 2/2010 Kelleher et al.
2010/0075557 A1 3/2010 Shteiyer
2010/0112312 A1 5/2010 Tutterow et al.
2010/0143683 A1 6/2010 Chiou
2010/0297905 A1 11/2010 Ulrich et al.
2011/0010827 A1 1/2011 Stanhope et al.
2011/0023206 A1 2/2011 Dunn
2011/0138523 A1 6/2011 Layson, Jr. et al.
2011/0191949 A1 8/2011 Underwood et al.
2011/0250810 A1 10/2011 Zhu
2012/0031783 A1 2/2012 Fay, III et al.
2012/0090080 A1 4/2012 Stanhope et al.
2012/0183747 A1 7/2012 Bader
2012/0210481 A1 8/2012 Rock
2012/0270456 A1 10/2012 Gstettner et al.

(56) References Cited

U.S. PATENT DOCUMENTS

| | | | | |
|---|---|---|---|---|
| 2013/0205481 | A1* | 8/2013 | Underwood | A41D 27/02 2/455 |
| 2013/0216810 | A1 | 8/2013 | Hines et al. | |
| 2013/0254980 | A1* | 10/2013 | Underwood | A41D 31/0022 2/458 |
| 2016/0128484 | A1* | 5/2016 | Gross | B32B 5/022 297/452.1 |

FOREIGN PATENT DOCUMENTS

| | | |
|---|---|---|
| WO | WO 2007/061423 | 5/2007 |
| WO | WO 2010/091476 | 8/2010 |

* cited by examiner

FIG. —1—

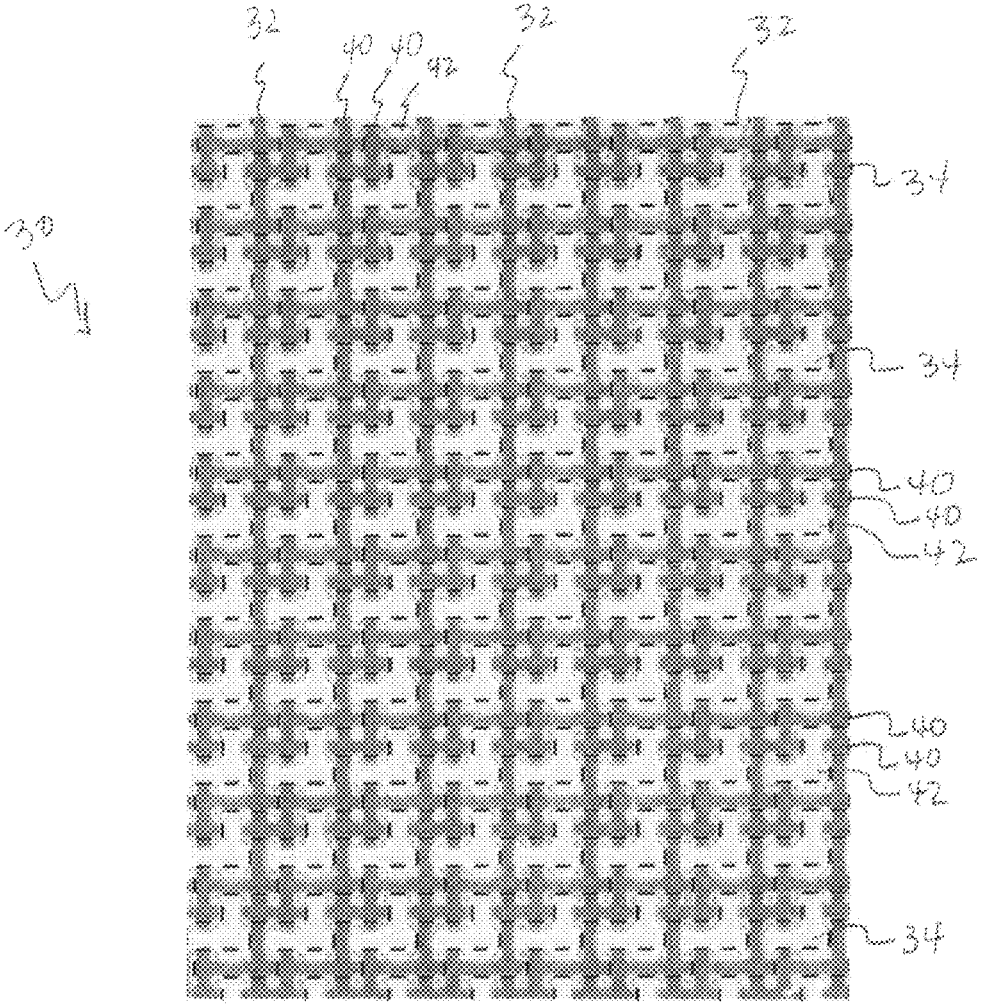
FIG. —4—

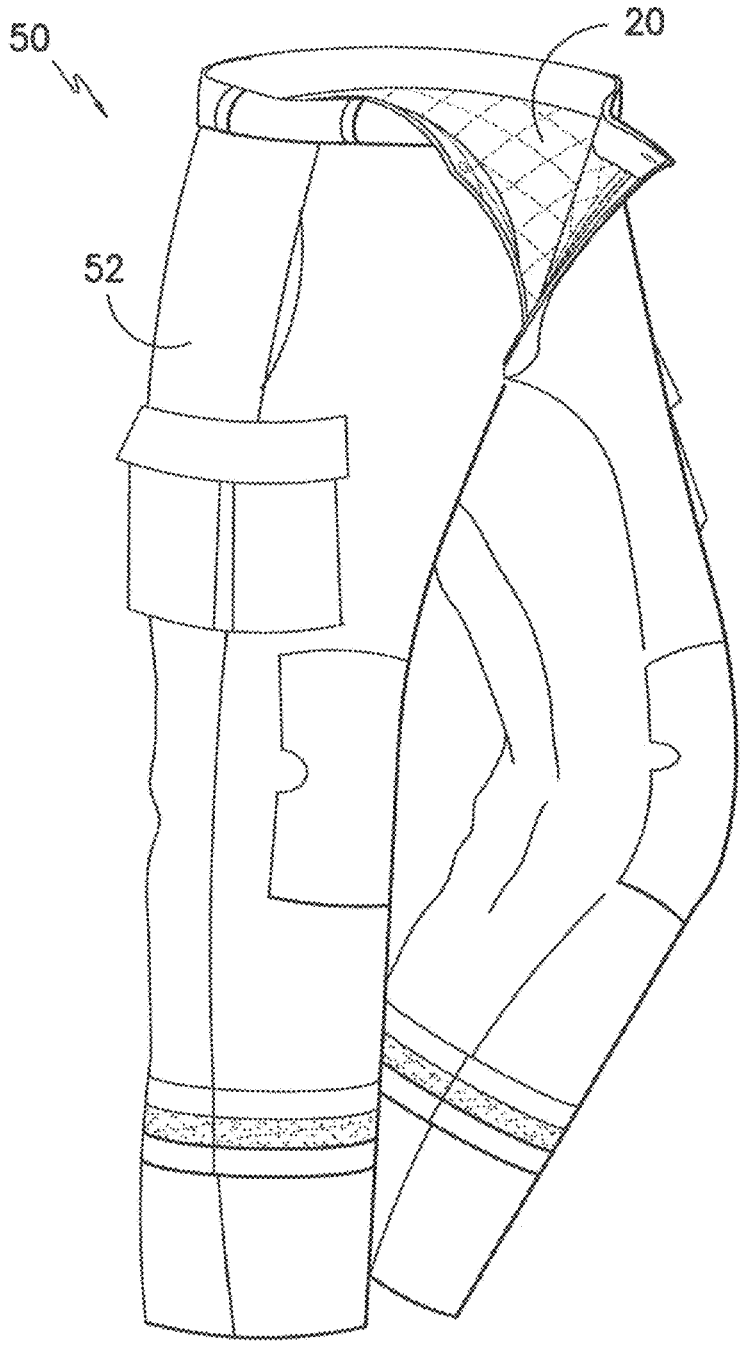
FIG. –5–

INNER LINING FABRIC

RELATED APPLICATIONS

The present application claims priority to and is based on U.S. Provisional Patent Application Ser. No. 62/164,856, filed on May 21, 2015; U.S. Provisional Patent Application Ser. No. 62/257,990, filed on Nov. 20, 2015, and wherein all of the above identified provisional applications are hereby incorporated by reference.

BACKGROUND

Various different types of protective garments exist that are designed to protect the wearer in the environment in which the garment is worn. For instance, various protective garments exist that are intended to be fire resistant. Such garments are worn by military personnel, industrial workers, pilots, rescue personnel, and firefighters.

Firefighter garments, for instance, are intended to not only protect the firefighter from exposure to fires but are also designed to be water resistant. Firefighter garments typically include multiple layers of materials. For example, firefighter garments typically include an outer shell attached to an inner lining or face cloth. The firefighter garment may include intermediate layers, such as a moisture barrier layer and/or a thermal barrier layer. Each layer can be made from fire resistant materials, such as fire resistant fibers and yarns.

Many protective garments, such as firefighter garments, are intended not only to protect the wearer from fire and other elements, but the garments should also be comfortable to wear. For example, firefighter garments that do not provide water resistance may absorb water during use and increase in weight thereby increasing the load on the wearer.

The inner lining of protective garments as described above should also display high lubricity characteristics. A low friction inner lining, for instance, makes it much easier to don the garment and to take the garment off later. A low friction inner lining also can substantially increase the comfort of the garment during use, especially when the wearer is actively moving. Ultimately, a low friction inner lining can reduce the amount of stress imposed on the wearer, especially when worn in harsh environments.

In this regard, those skilled in the art in the past have attempted to produce inner linings for protective garments that are not only fire resistant but also have excellent lubricity characteristics. For example, inner linings made from multi-filament yarns and spun yarns are disclosed in U.S. Pat. Nos. 6,247,179, 5,858,888, and U.S. Patent Application Publication No. 20130205481 which are incorporated herein by reference. The inner linings disclosed in the above patents have provided great advancements in the art demonstrated by significant commercial success. U.S. Pat. No. 5,539,928 and U.S. Patent Publication No. 2009/0255038, which are also both incorporated herein by reference, also disclose inner liners having high lubricity characteristics.

One problem with prior inner lining fabrics, however, is that the fabrics have not had balanced properties in the warp direction and the fill direction. For instance, many prior fabrics had better properties in one direction in comparison to a perpendicular direction. Unbalanced shrinkage characteristics, for instance, can cause fabrics to lose dimensional stability after being laundered. Unbalanced shrinkage characteristics can especially have adverse consequences in relatively lightweight fabrics, such as inner liners.

The present disclosure is directed to further improvements in the construction of protective garments and particularly in the construction of high lubricity liners for protective garments. More particularly, the present disclosure is directed to producing inner lining fabrics that have more balanced properties in both the warp direction and the fill direction. In one embodiment, for instance, the present disclosure is directed to an inner lining for a fire resistant garment that has balanced shrink properties in both the warp direction and the fill direction.

SUMMARY

In general, the present disclosure is directed to protective garments having an inner lining with excellent lubricity and high strength characteristics. More particularly, the present disclosure is directed to an inner lining that has balanced physical properties, such as strength and shrinkage characteristics, in both the warp direction and fill direction. In one embodiment, the protective garment and the inner lining may be constructed so as to provide protection to a wearer against fires, open flames, incendiary devices, and the like.

In one embodiment, the protective garment includes an outer shell having an exterior surface and an inside surface. An inner lining is positioned on the inside surface of the outer shell. For instance, the inner lining can be directly affixed to the outer shell or may be attached to a garment subassembly that is then connected to the outer shell.

The inner lining comprises a woven fabric having filament yarns and spun yarns. The fabric includes a warp direction and a fill direction. The filament yarns and the spun yarns are present in the warp direction in a ratio of greater than 1:1 to about 5:1. The filament yarns and the spun yarns are also present in the fill direction in a ratio of from greater than 1:1 to about 5:1. For instance, the ratio of the filament yarns and the spun yarns in the warp direction and the fill direction can be greater than 1:1 to about 3:1. In one particular embodiment, the filament yarns and the spun yarns are present in the warp direction and are present in the fill direction at a ratio of about 2:1. The filament yarns and spun yarns can be positioned in the fabric such that after each single spun yarn there is greater than one and up to about five filament yarns. This pattern can repeat in both the warp direction and the fill direction. In one embodiment, the fabric is constructed so that no two single spun yarns are adjacent to each other. In one embodiment, the ratio between the filament yarns and the spun yarns is the same in both the warp direction and in the fill direction.

The filament yarns can be made from a synthetic polymer and/or from natural materials. In one embodiment, the filament yarns are made from an inherently flame resistant material. For instance, the filament yarns can be made from an aramid polymer such as a para-aramid polymer or a meta-aramid polymer. In one embodiment, the filament yarns are made exclusively from para-aramid filaments. The filament yarns can have a denier of from about 100 to about 400.

The spun yarns contained within the inner lining may contain flame resistant fibers, such as inherently flame resistant fibers alone or in combination with cellulose fibers that have been treated with a flame retardant composition. In one embodiment, the spun yarns may contain solely aramid fibers, such as para-aramid fibers and/or meta-aramid fibers. In other embodiments, the spun yarns may contain aramid fibers in combination with FR cellulose fibers. In still yet another embodiment, the spun yarns may contain synthetic fibers such as polyamide fibers in combination with inherently flame resistant fibers and/or FR cellulose fibers.

The spun yarns contained in the fabric can all be made from the same fiber furnish wherein the fibers are present in the same proportions. In alternative embodiments, spun yarns can be contained in the fabric that are made from a different fiber furnish. For instance, the fabric may contain two or three different types of spun yarns.

In general, the inner lining can have a basis weight of from about 2 osy to about 5 osy, such as from about 2.5 osy to about 4 osy. In one particular embodiment, the inner lining may comprise a fabric having a twill weave. The fabric can have from about 70 to about 90 ends per inch and from about 60 to about 80 picks per inch.

In one embodiment, the filament yarns and spun yarns can be present in the fabric and woven together such that the fabric substantially looks the same when viewing a first side of the fabric or when viewing an opposite second side of the fabric. For instance, in one embodiment, the same amount of filament yarns present on the first side of the fabric are also present on the second side of the fabric.

Inner linings made according to the present disclosure can have excellent flame resistant properties, even after being laundered. For instance, the inner lining may display a char length of less than about 40 mm, such as less than about 30 mm, such as even less than about 20 mm in at least one direction when tested according to ASTM Test D6413 and after being subjected to five laundry cycles.

In one embodiment, the inner lining can further be treated with an odor control agent. The odor control agent may comprise, for instance, a silver ion. In one embodiment, for instance, the odor control agent may comprise a silver zeolite.

Other features and aspects of the present disclosure are discussed in greater detail below.

BRIEF DESCRIPTION OF THE DRAWINGS

A full and enabling disclosure of the present invention, including the best mode thereof to one skilled in the art, is set forth more particularly in the remainder of the specification, including reference to the accompanying figures, in which:

FIG. 4 is an enlarged view of one embodiment of an inner lining made in accordance with the present disclosure; and FIG. 5 is a perspective view with cutaway portions of one embodiment of trousers made in accordance with the present disclosure.

Figure 1:
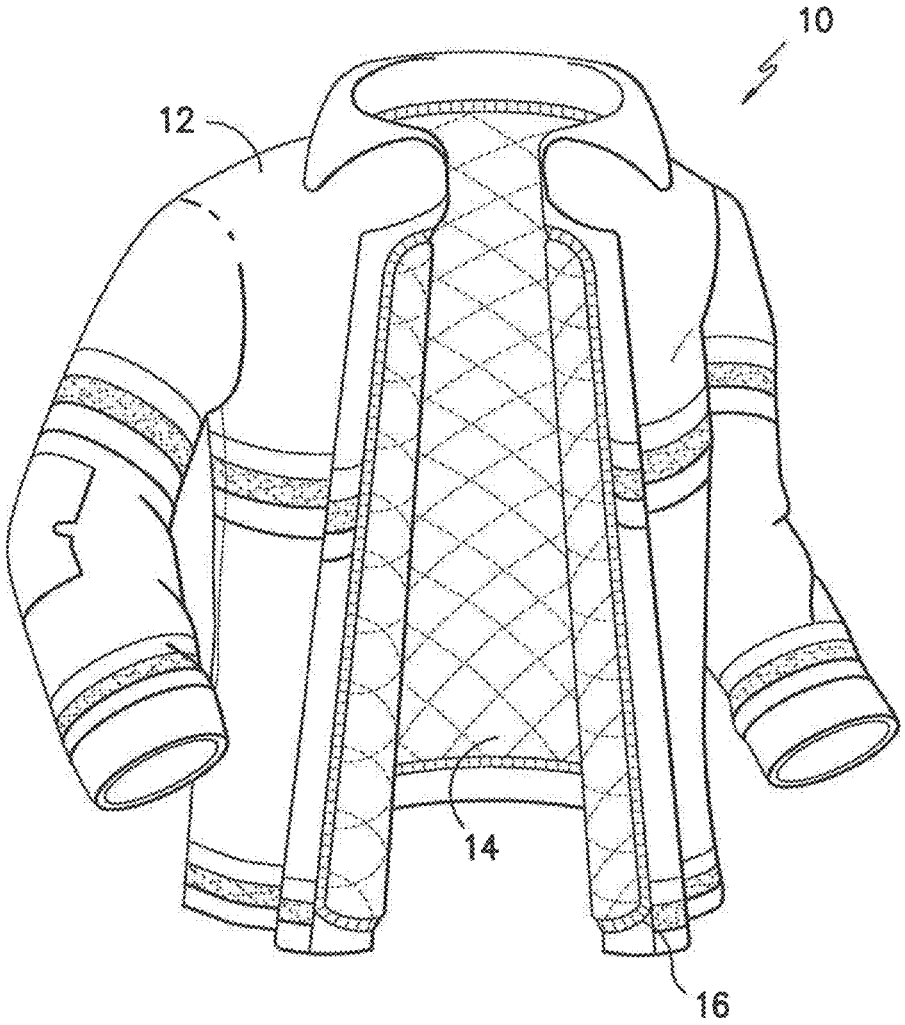
FIG. 1 is a perspective view of one embodiment of a protective garment made in accordance with the present disclosure.
Figure 2:
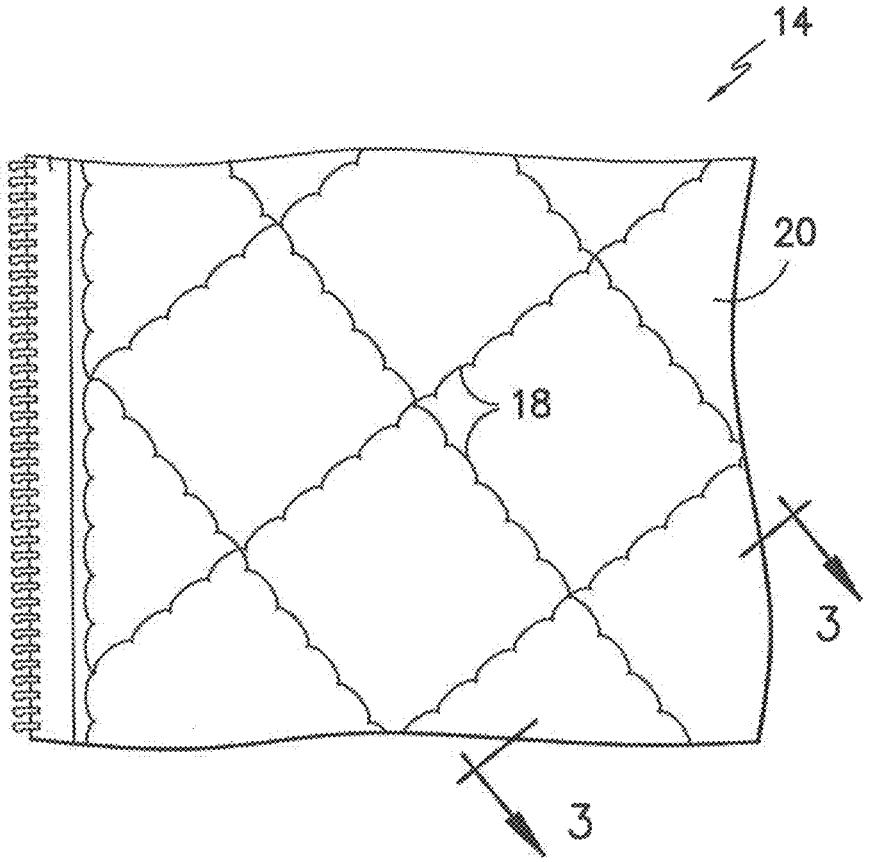
FIG. 2 is a plan view of one embodiment of an inner lining made in accordance with the present disclosure.

Repeat use of reference characters in the present specification and drawings is intended to represent the same or analogous features or elements of the present invention.

DETAILED DESCRIPTION

It is to be understood by one of ordinary skill in the art that the present discussion is a description of exemplary embodiments only, and is not intended as limiting the broader aspects of the present disclosure.

In general, the present disclosure is directed to protective garments that include an inner liner. In one embodiment, the protective garment is flame resistant and thus protects the wearer from exposure to fire, including flash fires. The inner liner can be constructed to not only be flame resistant but can also have high lubricity characteristics. In comparison to lining materials used in the past, the inner liner has better balanced properties when comparing properties in the warp direction to properties in the fill direction. For instance, in one embodiment, the shrinkage characteristics of the fabric in the warp direction substantially matches the shrinkage characteristics of the fabric in the fill direction. In this manner, this fabric has dramatically better dimensional stability especially after being laundered multiple times.

In general, the inner liner of the present disclosure is made from a woven fabric that includes at least two different types of yarns. The first yarn comprises a spun yarn that may contain inherently fire resistant fibers, such as aramid fibers. The second yarns, on the other hand, comprise multifilament yarns that may be made from an inherently fire resistant material. In accordance with the present disclosure, the filament yarns and the spun yarns are woven together to form a fabric such that the fabric has balanced properties in a warp direction and in a fill direction. For instance, in one embodiment, the fabric may include a first yarn pattern in the warp direction and a second yarn pattern in the fill direction. Each yarn pattern may be comprised of greater than one filament yarn grouped together and then followed by only a few spun yarns, such as no more than two spun yarns, such as, in one embodiment, one spun yarn. The pattern in the warp direction can be the same or different than the pattern in the fill direction. In one embodiment, the pattern in the warp direction is the same as the pattern in the fill direction so that the strength properties of the fabric are substantially equal in each direction.

For instance, in one embodiment, the inner lining fabric of the present disclosure includes filament yarns and spun yarns that extend in the warp direction and filament yarns and spun yarns that extend in the fill direction. In one embodiment, the filament yarns and the spun yarns can be present in the warp direction in a ratio of greater than 1:1 to about 5:1, such as greater than 1:1 to about 3:1 and, in one embodiment, at a ratio of 2:1. Similarly, in the fill direction, the filament yarns and the spun yarns can be present in a ratio of greater than 1:1 to about 5:1, such as greater than 1:1 to about 3:1, such as, in one embodiment, at a ratio of 2:1. The ratio of the filament yarns to the spun yarns can be the same in both the warp direction and the fill direction or can be different. For instance, the ratio can be slightly altered in each direction in order to ensure that the physical properties in each direction match, especially the shrinkage properties.

In one embodiment, in both the warp direction and the fill direction, the ratio of yarns is such that before and after each single spun yarn is more than one and up to five filament yarns. For example, in one embodiment, the fabric may be constructed so that no two spun yarns are located adjacent to each other in either the warp direction or the fill direction.

By having a greater amount of filament yarns in comparison to spun yarns, various different advantages are obtained. For instance, the greater number of filament yarns can increase the strength of the fabric in both the warp direction and the fill direction. In many prior lining fabrics, on the other hand, multifilament yarns were only present in a single direction which led to the fabric having either a weaker fill direction or a weaker warp direction. Having greater amounts of filament yarns in both the warp direction and the fill direction also provides the fabric with excellent lubricity characteristics.

FIG. 1 illustrates an improved protective garment 10 constructed in accordance with the present disclosure. Garment 10 includes a relatively tough outer shell 12 having a liner assembly 14 located therein. Outer shell 12 and liner assembly 14 together function to protect a wearer from heat and flame such as may be encountered during firefighting activities.

Liner assembly 14 may be constructed as a separate unit that may be removed from outer shell 12. A zipper 16 is provided in this case to maintain liner assembly 14 in position within outer shell 12 as shown. It should be appreciated, however, that other suitable means of attachment, such as various hook and pile arrangements, may also be utilized for this purpose.

In an alternative embodiment, the liner can be permanently attached to the garment.

Figure 3:
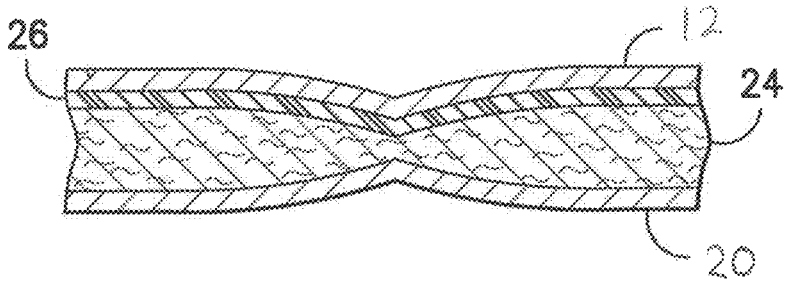
FIG. 3 is a cross-sectional view taken along lines 3-3 of FIG. 2.

Referring to FIG. 3, one embodiment of a multi-layered garment in accordance with the present disclosure is shown. As shown, the garment includes a plurality of material layers quilted together by crisscrossing stitch lines 18. The stitch lines may hold together a thermal barrier layer 24, a moisture barrier layer 26, and a lining layer 20.

Typically, lining layer 20 will be adjacent the wearer's body during use. As will be described more fully below, lining layer 20 is made from a textile material having high lubricity and balanced properties. The higher lubricity characteristics make the surface of lining layer 14 relatively "slick." This construction desirably reduces the friction that may otherwise be produced by rubbing against the wearer's clothing.

In the illustrated embodiment, an aramid felt, such as a felt produced from meta-aramid fibers, is utilized to provide thermal barrier layer 24. The felt functions as an insulator to inhibit transfer of heat from the ambient environment to the wearer.

Moisture barrier layer 26 is preferably a suitable polymeric membrane that is impermeable to liquid water but is permeable to water vapor. As such, exterior water (such as from a firefighter's water hose) will not penetrate the interior of garment 10, but perspiration from the firefighter can escape. Suitable membranes of this type are distributed by W. L. Gore & Associates under the trademark Gore-Tex.

In addition to being used in coats and jackets as shown in FIG. 1, the lining layer of the present disclosure may also be used to line other garments. For instance, referring to FIG. 5, a pair of trousers made in accordance with the present disclosure is illustrated. As shown, the trousers 50 include an outer shell 52 similar to the outer shell 12 shown in FIG. 1. In addition, the trousers 50 include a lining layer 20 positioned to be adjacent the wearer's body during use.

FIG. 4 illustrates an improved textile material 30 such as may be used to construct lining layer 20. As shown, textile material 30 includes a plurality of warp yarns 32 interwoven with a plurality of fill yarns 34. In accordance with the present disclosure, the fabric includes filament yarns 40 that extend both in the warp direction and the fill direction. The fabric further comprises spun yarns 42 that also extend in both the warp direction and the fill direction. In the embodiment illustrated in FIG. 4, the spun yarns are positioned at every third yarn in both the warp direction and the fill direction. In other words, the yarn pattern of fabric 30 is spun-filament-filament-spun-filament-filament-spun-filament-filament and so forth in both the warp direction and the fill direction. As shown in FIG. 4, the combination of yarns in the warp direction and the fill direction produces a fabric having a very distinctive look. The spun yarns, for instance, can have a different texture and/or a different color than the filament yarns. In this manner, the woven fabric not only has balanced physical properties but also has an overall aesthetically pleasing look.

In FIG. 4, the amount of filament yarns also forms the background matrix of the weave. The spun yarns, on the other hand, form islands in the filament matrix. In particular, where the spun yarns appear on the face of the fabric, they are surrounded by filament yarns.

The spun yarns can be made from fibers that are inherently flame resistant and/or are fibers treated with a flame retardant composition alone or in combination with other fibers, such as polyamide fibers. The filament yarns can also be made exclusively from inherently flame resistant fibers and/or fibers treated with a flame retardant composition. In other embodiments, the filament yarns, which may comprise multifilament yarns, may also contain synthetic fibers, such as polyamide fibers. In an alternative embodiment, the filament yarns may comprise core spun yarns.

The fabric can be constructed such that all of the filament yarns are made from the same fibers in the same amounts and all of the spun yarns can be made from the same fibers in the same amounts. In an alternative embodiment, the fabric may include different types of filament yarns and/or different types of spun yarns. The fiber furnish of the filament yarns and/or the spun yarns, for instance, may change from yarn to yarn in order to produce a fabric having certain desired properties.

In various embodiments, the filament yarns may comprise multifilament yarns containing aramid fibers, poly-p-phenylenebenzobisoxazole fibers (PBO fibers), FR cellulose fibers, such as FR viscose filament fibers, synthetic fibers such as polyamide fibers, and mixtures thereof. In one embodiment, the filament yarns are made exclusively from inherently flame resistant fibers. For instance, the filament yarns may be made exclusively from para-aramid fibers or meta-aramid fibers.

The use of para-aramid filament yarns may produce various advantages and benefits. For example, the tensile strength of the fabric in both the warp direction and the fill direction can be increased. For example, in the warp direction and the fill direction, the fabric can have a tensile strength measured according to ASTM Test D5034 of greater than 350 lbsf, such as greater than 400 lbsf, such as greater than 450 lbsf, such as greater than 500 lbsf, such as even greater than 550 lbsf. The tensile strength is generally less than about 1200 lbsf. The above strength properties are for fabrics having a basis weight of from about 2 osy to about 6 osy, such as from about 2 osy to about 5 osy, such as from about 2 osy to about 4 osy or less than 4 osy.

When incorporating para-aramid filament yarns into the fabric, the yarns may also be incorporated into the fabric having a minimal amount of twists. For example, filament yarns can be twisted less than five twists per inch, such as less than four twists per inch, such as even less than three twists per inch. In one embodiment, for instance, the filament yarns may not have any appreciable twisting. By not having to twist the filament yarns, the lubricity of the resulting fabrics can actually be enhanced in certain embodiments.

The use of inherently flame resistant filament yarns such as para-aramid yarns may also appreciably increase the flame resistant properties of the fabric. For instance, fabrics made in accordance with the present disclosure, even after being laundered five laundry cycles, can have a char length in a direction perpendicular to the filament yarns when tested according to ASTM Test D6413 (AATCC 135) of less than about 50 mm, such as less than about 40 mm, such as even less than about 30 mm. The char length, for instance, can be generally from about 5 mm to about 50 mm. In one particular embodiment, the char length in both directions can be less than about 15 mm.

The weight of the filament yarns can vary depending upon the particular application, the desired weight of the fabric, and various other factors. In general, the filament yarns can have a weight of greater than about 100 denier, such as greater than about 140 denier, such as greater than about 180 denier. The denier of the filament yarns is generally less than about 500 denier, such as less than about 400 denier. In one embodiment, the filament yarns have a denier of from about 150 to about 250, such as from about 180 to about 220.

The spun yarns can also be made from different types of fibers. For instance, the spun yarns can be made exclusively from inherently flame resistant fibers or can comprise a blend of inherently flame resistant fibers in conjunction with other fibers such as FR cellulose fibers and/or polyamide fibers.

In one embodiment, the spun yarns may be made from a blend of fibers. For instance, in one embodiment, the spun yarns may comprise meta-aramid fibers blended with para-aramid fibers. For instance, the para-aramid fibers may be present in an amount less than the meta-aramid fibers, such as in an amount less than about 15% by weight, such as from about 1% to about 15% by weight, such as from about 3% to about 10% by weight.

The spun yarns can contain the meta-aramid fibers in an amount greater than about 30% by weight, such as in an amount from about 30% by weight to about 100% by weight. The meta-aramid fibers may be present in the spun yarns in an amount greater than about 40% by weight, such as in an amount greater than 60% by weight, such as in an amount greater than about 80% by weight.

The meta-aramid fibers contained in the spun yarns can be substantially amorphous, crystalline, or a mixture of both. Amorphous meta-aramid fibers generally have a crystallinity of less than about 10%. Crystalline fibers, on the other hand, have a crystallinity greater than about 10%, such as greater than about 25%, such as having a crystallinity of from about 25% to about 40%.

In an alternative embodiment, instead of meta-aramid fibers, the spun yarns can contain primarily para-aramid fibers. For instance, the spun yarns can contain para-aramid fibers in an amount greater than 15% by weight, such as greater than about 30% by weight, such as greater than about 40% by weight, such as even greater than 60% by weight. In general, the spun yarns can contain para-aramid fibers in an amount up to 100% by weight, such as less than about 80% by weight, such as less than about 60% by weight.

In addition to meta-aramid fibers and/or para-aramid fibers, the spun yarns may contain various other inherently flame resistant fibers. Such fibers may include, for instance, polybenzimidazole fibers, such as poly[2,2'-(m-phenylen)-5,5'bibenzim idazole].

In addition to inherently flame resistant fibers or instead of inherently flame resistant fibers, the spun yarns may also contain other fibers treated with a flame retardant composition. For instance, in one embodiment, the spun yarns may contain flame resistant cellulose fibers.

As used herein, flame resistant cellulose fibers refers to cellulose fibers that have been treated with a flame resistant composition or flame retardant. The inclusion of cellulose fibers in the fiber blend can make the resulting fabric softer, more breathable, and less expensive. Examples of flame resistant cellulose fibers that may be incorporated into the fabric include FR cotton, FR rayon, FR acetate, FR triacetate, FR lyocell, and mixtures thereof. In one particular embodiment, FR rayon fibers are incorporated into the fiber blend. FR rayon fibers are available from various different sources. FR rayon fibers, for instance, are sold under the name LENZING by Lenzing Fibers of Austria. LENZING FR fibers are viscous fibers that have been treated with a flame retardant composition. In one embodiment, the flame resistant rayon fibers are made by spinning reconstituted cellulose from beech trees. Such fibers are more water absorbent than cotton fibers.

The amount of flame resistant cellulose fibers present in the spun yarns may depend upon various different factors and the particular application. In one embodiment, for instance, the flame resistant cellulose fibers may be present in the spun yarns in an amount from about 20% to about 100% by weight. In one particular embodiment, for instance, the flame resistant cellulose fibers may be present in the spun yarns in an amount from about 30% to about 50% by weight. In various different embodiments, the amount of flame resistant cellulose fibers present in the spun yarns can depend upon the amount of other fibers present and the type of fibers present. In general, flame resistant cellulose fibers may be present in the spun yarns in an amount greater than about 5% by weight, such as in an amount greater than 10% by weight, such as in an amount greater than 15% by weight, such as in an amount greater than 20% by weight, such as in an amount greater than 25% by weight, such as in an amount greater than 30% by weight, such as in an amount greater than 35% by weight, such as in an amount greater than 40% by weight, such as in an amount greater than 45% by weight, such as in an amount greater than 50% by weight, such as in an amount greater than 55% by weight, such as in an amount greater than 60% by weight, such as in an amount greater than 65% by weight, such as in an amount greater than 70% by weight, such as in an amount greater than 75% by weight, such as in an amount greater than 80% by weight. In one embodiment, the spun yarns may be made entirely from the flame resistant cellulose fibers. In general, however, the flame resistant cellulose fibers are generally present in an amount less than about 80% by weight, such as in an amount less than about 75% by weight, such as in an amount less than about 70% by weight, such as in an amount less than about 65% by weight, such as in an amount less than about 60% by weight, such as in an amount less than about 55% by weight, such as in an amount less than about 50% by weight, such as in an amount less than about 45% by weight, such as in an amount less than about 40% by weight, such as in an amount less than about 35% by weight, such as in an amount less than about 30% by weight, such as in an amount less than about 25% by weight, such as in an amount less than about 20% by weight, such as in an amount less than about 15% by weight.

As described above, flame resistant cellulose fibers comprise fibers that have been treated with a flame retardant composition. The flame retardant composition can be incorporated into the fibers using various methods and techniques. For instance, the flame retardant composition can be incorporated into the fibers during spinning, can be coated on the fibers, or can be absorbed into the fibers. The flame retardant composition may contain, for instance, a phosphorus compound, a halogen compound, or any other suitable flame resistant agents.

In still other embodiments, the spun yarns may contain synthetic fibers, such as polyamide fibers and/or polyester fibers. In one embodiment, the polyamide fibers and/or polyester fibers may contain or may be treated with a fire retardant. In one particular embodiment, spun yarns can be contained in the fabric that contain a combination of aramid fibers, FR cellulose fibers, and polyamide fibers. The polyamide fibers may be present in an amount up to 20% by weight, such as in an amount from about 3% to about 15% by weight.

Similar to the filament yarns, the weight of the spun yarns can also vary depending upon the particular application. The spun yarns, for instance, can have a weight of from about 20/1 to about 50/1.

In general, the spun yarns and filament yarns are woven together such that the filament yarns comprise more than about 50% of the surface area of one side of the fabric, such as both sides of the fabric. For instance, the filament yarns may comprise greater than about 60%, such as greater than about 70%, such as even greater than about 80% of each side of the fabric. The filament yarns provide a fabric with high lubricity characteristics.

In one embodiment, the warp yarns 32 and the fill yarns 34 are woven together using a twill weave.

In another embodiment, warp yarns 32 and fill yarns 34 are woven together utilizing a satin weave in order to achieve the desirable qualities discussed above. In a satin weave, the interlacing of each warp yarn is at least one fill yarn apart from the interlacing of either of the two warp yarns next to it. The points of interlacing do not produce an unbroken line (such as with a twill weave), but are scattered about over the weave. The interlacings of the warp yarns are thus hidden by adjacent floats.

In one embodiment, the filament yarns may have a size or weight greater than the spun yarns. In this regard, the filament yarns may comprise greater than 50% of the overall weight of the fabric, such as greater than about 55%, such as greater than about 60% of the overall weight of the fabric, such as greater than about 70% of the overall weight of the fabric. Having larger filament yarns and/or more filament yarns can improve the lubricity properties of the fabric.

In general, the fabric of the present disclosure may be treated with various finishes. In one particular embodiment, for instance, the fabric may be treated with an anti-odor agent. For instance, the anti-odor agent may comprise metal ions, such as silver ions. The silver ions may act as an antimicrobial agent for reducing odors. In one embodiment, the silver ions may be present in a compound or complex that also absorbs odors. For instance, in one embodiment, the silver ions may be present in a porous zeolite.

In one embodiment, the fabric of the present disclosure may be powder coated with an anti-odor agent. For instance, the anti-odor agent may be in the form of particles having a size of less than about 1 micron, such as from about 0.001 microns to about 1 micron. The anti-odor agent may be combined with a pre-polymer or polymer. The resulting particles may then be heated and applied to the fabric. The polymer or pre-polymer forms an attachment to the surface. The polymer or pre-polymer may comprise a thermoplastic polymer or a thermosetting polymer. The polymer may comprise, for instance, polyester resins, epoxy resins, acrylic resins, phenol resins, melamine resins, urea resins, urethane resins, vinylether resins, and the like. Other polymers include polyam ides, polymethylmethacrylate, and polyolefins.

In an alternative embodiment, the anti-odor agent may be contained in a finish that is then applied to the fabric. The finish may include binders, leveling agents, adherents, thickeners, and the like. For instance, in one embodiment, a binder, such as a polyurethane or an acrylic-type resin may be combined with the anti-odor agent and applied to the fabric as a liquid. Once applied, the fabric may be dried.

The present disclosure may be better understood with reference to the following examples.

EXAMPLES

The following fabrics were produced and tested for various properties. In particular, a fabric was made in accordance with the present disclosure and a fabric was made in accordance with U.S. patent application Ser. No. 13/396,125, filed on Feb. 14, 2012. Both fabrics were tested for various properties and the results are shown in the table below.

Example No. 1

First Yarn: 200 denier para-aramid multifilament yarn
Yarn No. 2: 28/1 spun yarn containing 80% meta-aramid fibers and 20% by
weight FR cellulose fibers
Ends: 66 per inch
Picks: 68 per inch
Weight: 3.55 osy
Weave: 2×1 twill weave
Fabric construction: The fabric was constructed such that in the warp direction and in the fill direction the yarn repeat was spun yarn, filament yarn, filament yarn, spun yarn, filament yarn, filament yarn, etc.

Example No. 2

Warp Yarn: 200 denier para-aramid multifilament yarn with no twists per inch Fill Yarn: 26/1 spun yarn containing 65% meta-aramid fibers and 35% by weight FR cellulose fibers
Ends: 75 per inch
Picks: 56 per inch
Weight: 3.66 osy
Weave: 2×1 twill weave The above fabrics were tested and the following properties were obtained.

| TEST_METHOD | TEST_NAME | UNIT | Example No. 1 | Example No. 2 |
|---|---|---|---|---|
| AATCC 135 | SHRINK FILL 5X | PERCENT | 0.0 | 4.5 |
| | SHRINK WARP 5X | PERCENT | 3.0 | 0 |
| ASTM D 1777 | THICKNESS | INCHES | 0.01 | 0.011 |
| ASTM D 3774 | WIDTH | INCHES | 65 | 62 |
| ASTM D 3775 | ENDS | THRDS_IN | 66 | 75 |
| | PICKS | THRDS_IN | 68 | 56 |
| ASTM D 3776 | WEIGHT | OZ_SQ_YD | 3.55 | 3.66 |
| ASTM D 4032 | CIRCULAR BEND FILL | POUNDS | 0.7 | 0.4 |
| | CIRCULAR BEND WARP | POUNDS | 0.6 | 0.4 |
| ASTM D 5034 | BREAK STRENGTH FILL | POUNDS | 446 | 72 |
| | BREAK STRENGTH WARP | POUNDS | 391 | 713 |
| | ELONG FILL | PERCENT | 10 | 19 |

-continued

| TEST_METHOD | TEST_NAME | UNIT | Example No. 1 | Example No. 2 |
|---|---|---|---|---|
| | ELONG WARP | PERCENT | 9 | 9 |
| ASTM D 5587 | TRAP TEAR FILL | POUNDS | 86 | 18 |
| | TRAP TEAR WARP | POUNDS | 76 | 107 |
| ASTM D 6413 | AFTER FLAME FILL | SECONDS | 0 | 0 |
| | AFTER FLAME WARP | SECONDS | 0 | 0 |
| | AFTER GLOW FILL | SECONDS | 2 | 1 |
| | AFTER GLOW WARP | SECONDS | 3 | 1 |
| | CHAR LENGTH FILL | MM | 10 | 11 |
| | CHAR LENGTH WARP | MM | 8 | 39 |
| | DRIP FILL | NONE | 0 | 0 |
| | DRIP WARP | NONE | 0 | 0 |
| ASTM D 6413 (AATCC 135) | AFTER FLAME FILL 5X | SECONDS | 0 | 0 |
| | AFTER FLAME WARP 5X | SECONDS | 0 | 0 |
| | AFTER GLOW FILL 5X | SECONDS | 2 | 1 |
| | AFTER GLOW WARP 5X | SECONDS | 3 | 1 |
| | CHAR LENGTH FILL 5X | MM | 13 | 10 |
| | CHAR LENGTH WARP 5X | MM | 11 | 38 |
| | DRIP FILL 5X | NONE | 0 | 0 |
| | DRIP WARP 5X | NONE | 0 | 0 |
| NFPA 1971 8.6 | SHRINK FILL 5MN 500F | PERCENT | 0.0 | 1.1 |
| | SHRINK WARP 5MN 500F | PERCENT | 0.5 | 0.0 |

As shown above, the fabric made according to the present disclosure possessed more balanced properties, especially with respect to breaking strength and trap tear. The overall shrinkage characteristics were also improved.

More particularly, the fabric in accordance with the present disclosure had trap tear properties in the fill or weft direction that was within 30%, such as within 25%, such as within 20%, such as within 15% of the trap tear properties of the fabric in the warp direction. In comparison, Example No. 2 displayed an 83% difference between the trap tear properties in the fill direction and the trap tear properties in the warp direction.

The fabric in accordance with the present disclosure also had break strength properties in the fill or weft direction that was within 30%, such as within 25%, such as within 20%, such as within 15% of the break strength properties of the fabric in the warp direction. In comparison, Example No. 2 displayed a break strength in the fill direction that was approximately 90% different than the break strength properties in the warp direction.

These and other modifications and variations to the present invention may be practiced by those of ordinary skill in the art, without departing from the spirit and scope of the present invention, which is more particularly set forth in the appended claims. In addition, it should be understood that aspects of the various embodiments may be interchanged both in whole or in part. Furthermore, those of ordinary skill in the art will appreciate that the foregoing description is by way of example only, and is not intended to limit the invention so further described in such appended claims.

What is claimed:

1. A fire resistant garment comprising: an outer shell shaped to cover a portion of a wearer's body; an inner lining located inside of said outer shell and positioned to contact a wearer, the inner lining comprising a fabric having filament yarns and spun yarns, the fabric including a warp direction and a fill direction and wherein the filament yarns and the spun yarns are present in the warp direction in a ratio of greater than 1:1 to about 5:1 and wherein the filament yarns and spun yarns are also positioned in the fill direction in a ratio of from greater than 1:1 to about 5:1 and wherein each spun yarn is followed by greater than one and up to five filament yarns in both the warp direction and the fill direction and wherein no spun yarns are positioned adjacent next to each other in either the warp direction or the fill direction and wherein all the spun yarns contain a same fiber mixture in a substantially same amount.

2. A fire resistant garment as defined in claim 1, wherein the filament yarns and spun yarns are present in the warp direction in a ratio of greater than 1:1 to about 3:1 and wherein the filament yarns and spun yarns are also positioned in the fill direction in a ratio of from greater than 1:1 to about 3:1.

3. A fire resistant garment as defined in claim 1, wherein the ratio of filament yarns to spun yarns in the warp direction and the ratio of the filament yarns to spun yarns in the fill direction are the same.

4. A fire resistant garment as defined in claim 1, wherein the spun yarns contain aramid fibers.

5. A fire resistant garment as defined in claim 1, wherein the filament yarns comprise multifilament yarns containing para-aramid fibers.

6. A fire resistant garment as defined in claim 5, wherein the filament yarns only contain para-aramid fibers.

7. A fire resistant garment as defined in claim 1, wherein the inner lining fabric includes a first side and a second side and wherein the fabric is woven such that the amount of filament yarns residing on the first side is the same as the amount of filament yarns residing on the second side of the fabric.

8. A fire resistant garment as defined in claim 1, wherein the inner lining fabric has a twill weave.

9. A fire resistant garment as defined in claim 1, wherein the spun yarns contained in the inner lining are comprised only of aramid fibers.

10. A fire resistant garment as defined in claim 1, wherein the spun yarns contained in the inner lining are comprised of meta-aramid fibers.

11. A fire resistant garment as defined in claim 1, wherein at least certain of the spun yarns contained in the inner lining are comprised of a blend of aramid fibers and fire resistant cellulose fibers.

12. A fire resistant garment as defined in claim 1, wherein at least certain of the spun yarns contained in the inner lining are comprised of a blend of meta-aramid fibers and para-aramid fibers.

13. A fire resistant garment as defined in claim 12, wherein the at least certain of the spun yarns further contain fire resistant cellulose fibers, the fire resistant cellulose fibers being present in each of the certain of the spun yarns in an amount from about 10% to about 50% by weight.

14. A fire resistant garment as defined in claim 1, wherein the filament yarns contained in the inner lining fabric have a denier of less than 400.

15. A fire resistant garment as defined in claim 1, wherein both the filament yarns and the spun yarns contained in the inner lining comprise aramid fibers.

16. A fire resistant garment as defined in claim 1, further comprising a moisture barrier layer located in between the inner lining and the outer shell.

17. A fire resistant garment as defined in claim 1, further comprising a thermally-resistant felt layer located between the outer shell and the inner lining.

18. A fire resistant garment as defined in claim 1, wherein the fabric of the inner lining has a fill direction trap tear strength and a warp direction trap tear strength and wherein the percent difference between the trap tear strength in the fill direction and the trap tear strength in the warp direction is less than 30%.

19. A fire resistant garment as defined in claim 18, wherein the fabric of the inner lining has a fill direction break strength and a warp direction break strength and wherein the percent difference between the break strength in the fill direction and the break strength in the warp direction is less than 30%.

20. A fire resistant garment as defined in claim 1, wherein the fabric of the inner lining has a fill direction break strength and a warp direction break strength and wherein the percent difference between the break strength in the fill direction and the break strength in the warp direction is less than 30%.

* * * * *